US005436709A

United States Patent [19]

Sakaizawa et al.

[11] Patent Number: 5,436,709

[45] Date of Patent: Jul. 25, 1995

[54] FIXING DEVICE WHICH CONTROLS AN ENERGIZING CONDITION OF A HEATER AFTER FIXING OPERATION

[75] Inventors: Katsuhiro Sakaizawa; Yukihiro Ozeki, both of Tokyo, Japan

[73] Assignee: Canon Kabushiki Kaisha, Tokyo, Japan

[21] Appl. No.: 93,857

[22] Filed: Jul. 20, 1993

[30] Foreign Application Priority Data

Jul. 27, 1992 [JP] Japan ..... 4-218740

[51] Int. Cl.[6] ..... G03G 15/20

[52] U.S. Cl. ..... 355/285; 219/216; 355/208; 432/60

[58] Field of Search ..... 355/203, 208, 282, 285, 355/290, 295; 219/216, 469, 470; 432/60

[56] References Cited

U.S. PATENT DOCUMENTS 4,998,121 3/1991 Koh et al. ..... 355/285 X
5,032,874 7/1991 Matsuuchi ..... 355/285
5,109,255 4/1992 Nishikawa et al. ..... 355/285
5,276,482 1/1994 Nakanishi ..... 355/208

FOREIGN PATENT DOCUMENTS 52-12085 1/1977 Japan .
59-22074 2/1984 Japan ..... 355/285

*Primary Examiner*—A. T. Grimley
*Assistant Examiner*—William J. Royer
*Attorney, Agent, or Firm*—Fitzpatrick, Cella, Harper & Scinto

[57] ABSTRACT

A fixing device which can be employed in an image forming apparatus controls energization of a heater which heats a fixing device, and a detector for detecting the condition of fixing operations such as the temperature of the fixing device, energizing time of the heater, types of transfer sheets to be used, and the number of previously performed fixing operations. A controller selects from plural kinds of temperature control on the basis of the condition detected by the detector, and controls energization and temperature of the heater during fixing operation including a backward revolution of the fixing device which is performed after an image is fixed. With the above constitution, both an excellent fixing property of a thick transfer sheet in low temperature environment and prevention against curls and wrinkles of thin transfer sheets in high temperature environment can be realized.

13 Claims, 17 Drawing Sheets

FIXING DEVICE WHICH CONTROLS AN ENERGIZING CONDITION OF A HEATER AFTER FIXING OPERATION

BACKGROUND OF THE INVENTION

1. Field of the Invention

The present invention relates to a fixing device which fixes an unfixed image formed on a recording medium by heat, and which is used in an image forming apparatus such as a copying machine or a printer.

2. Related Background Art

A heating roller type fixing device is widely employed in an image forming apparatus such as a copying machine and a printer. Such a heating roller type fixing device effects fixing of an unfixed image by a heat source such as a halogen heater, while feeding a recording medium supporting the unfixed image by a pair of fixing rollers consisting of a heating roller and a pressure roller to be pressed thereto while pinching the recording medium (see, for example, Japanese Utility Model Publication No. 52-120856).

FIG. 17 shows an example of a fixing device of the heating roller type. A fixing roller 209 has a core bar 209*a* made of aluminum, iron, or the like which is coated with a mould releasable resin layer 209*b* such as PFA, PTFE, and the like. The fixing roller 209 further contains a halogen lamp 208 serving as a heat source, and is driven to rotate in a predetermined direction. The surface temperature of the fixing roller 209 is detected by a temperature detecting element 207 which is in contact with the fixing roller 209. The halogen lamp 208 is controlled according to a detection signal from the temperature detecting element 207 so that the surface temperature of the fixing roller 209 is maintained in the longitudinal direction at a constant value suitable for fixing operation.

A pressure roller 210 has a core bar 210*a* which is made of iron, stainless steel, or the like and which is coated with an elastic layer 210*b*, wherein the elastic layer 210*b* is made of a heat resistant and mould releasable material such as silicone rubber, fluoro-rubber, or the like. The pressure roller 210 is pressed against the fixing roller 209, and is driven to rotate with the fixing roller 209 in a predetermined direction.

Thus, a transfer medium P supporting a toner image T on the side of the fixing roller 209 is fed via an entrance guide 217 between the fixing roller 209 and the pressure roller 210, and is fed by them, while pinched at the pressing position therebetween, as the fixing roller 209 and the pressure roller 210 are rotated. During this time, the toner image T on the transfer medium P is heated and pressed by the fixing roller 209 and the pressure roller 210, thereby being fixed on the transfer medium P as a permanent image. The transfer medium P is separated from the fixing roller 209 by a separation claw 218.

In the heat fixing device of the heating roller type, when in low temperature environment, since the pressure roller 210 and the transfer medium P are cooled, heat escapes from the fixing roller 209 to the pressure roller 210 and the transfer medium P. When image output is constantly performed, temperature of the fixing roller 209 during image output is adjusted to be fixing temperature $T_2$ at which excellent fixation can be maintained.

It is because the pressure roller 210 is heated up by the fixing roller 209 during forward revolution and sheet feed, thus the surface temperature of the pressure roller 210 goes up as shown in FIG. 18. As a result, during sheet feed after print ON of second sheet, an outflow of heat to the pressure roller 210 decreases, thereby improving the fixing property.

If a sheet is intermittently fed, however, for example, if the image forming operation is resumed several seconds after discharging the transfer medium P out of the apparatus main body and stopping the image forming operation, the following problems occur, which depend on whether the temperature of the fixing roller 209 is controlled at the fixing temperature or not during the time when the transfer medium P passes through nip region formed by the fixing roller 209 and the pressure roller 210 pressed thereto, and then discharged to a discharge unit to stop the apparatus (the time is hereinafter referred as "backward revolution").

1. If the transfer media P are intermittently and repeatedly fed in low temperature environment, the fixing roller 209 is cooled during the backward revolution as shown in FIG. 9. And, since the halogen heater 208 is turned off, the pressure roller 210 is not heated up as efficiently as during continuous sheet feed. Thus, decrease of surface temperature of the fixing roller 209 and the outflow of heat from the transfer medium P to the pressure roller 210 during sheet feeding becomes greater after print ON of the second sheet, so that fixability is deteriorated.
2. If temperature control operation to maintain the fixing temperature is continued after the backward revolution begins, as the pressure roller 210 is heated up during the backward revolution as shown in FIG. 20 and the outflow of heat from the transfer medium P to the pressure roller 210 is reduced. Therefore, even if the sheets are intermittently fed in low temperature environment, an excellent fixing operation is possible. In high temperature environment, however, temperature rising on the discharge side of the fixing device becomes large. It is because decrease of the outflow of heat from the fixing roller 209 to the transfer medium P causes greater heat radiation into the atmosphere around the fixing roller 209, and accordingly, greater temperature rising. Such a case is illustrated in FIG. 21.

As a result, for example, a thin sheet of transfer medium P loses its toughness after sheet feed and tends to coil around the fixing roller 209, thereby causing a considerable curl after separation, and in the worst case, even wrinkle.

As described above, generally, temperature control of the fixing roller 209 during the backward revolution has never been taken into account, wherein temperature control is continued during the backward revolution for the sake of excellent fixing, somewhat, at the cost of prevention against curl and wrinkle of the sheet caused in high temperature environment. Otherwise, generally, the halogen heater 208 is turned off during the backward revolution for the sake of prevention against the curl and wrinkle of the sheet, somewhat, at the cost of exellent fixing.

Note that the above-mentioned problems become remarkable, depending on the kinds of sheets. For example, in the above case 1, the fixing property of a thin sheet whose base weight is 90 g/m$^2$ or less is relatively good, while that of a thick sheet such as a post card, an envelope, and the like whose base weight is greater than 130 g/m$^2$ becomes considerably worse.

In this case, the fixing temperature of the post card or the envelope may be set to be higher than that of other kinds of sheets. But, as the phenomena in said case 1 happens only in a low temperature environment, such a countermeasure causes excessive temperature rising in high temperature environment, which is also problematic.

Also, in the above case 2, the problems which are concerned with the postcard, the envelope, and the like can be avoided, but the curl and the wrinkle of the recording medium still occurs when a thin sheet is fed in high temperature environment.

SUMMARY OF THE INVENTION

An object of the present invention is to provide a fixing device which can realize both an excellent fixing operation of a thick sheet in low temperature environment and prevention against a curl and wrinkle of a recording medium in high temperature environment.

Another object of the present invention is to provide a fixing device comprising: a heated member to be heated by a heater; a pressure member for forming a nip area together with said heated member; a temperature detection member for detecting temperature of said heater; an energizing control means for controlling energizing so that temperature detected by said temperature detection member is maintained to be a predetermined fixing temperature; a discharge means for discharging a recording medium which has been subjected to fixing in said nip area out of the apparatus; and a condition control means for controlling energizing condition of said heater during time when the recording medium passes through the nip area and discharging by said discharge means.

Other objects of the present invention will be clearly understood in the following description.

DESCRIPTION OF THE PREFERRED EMBODIMENTS

Figure 1:
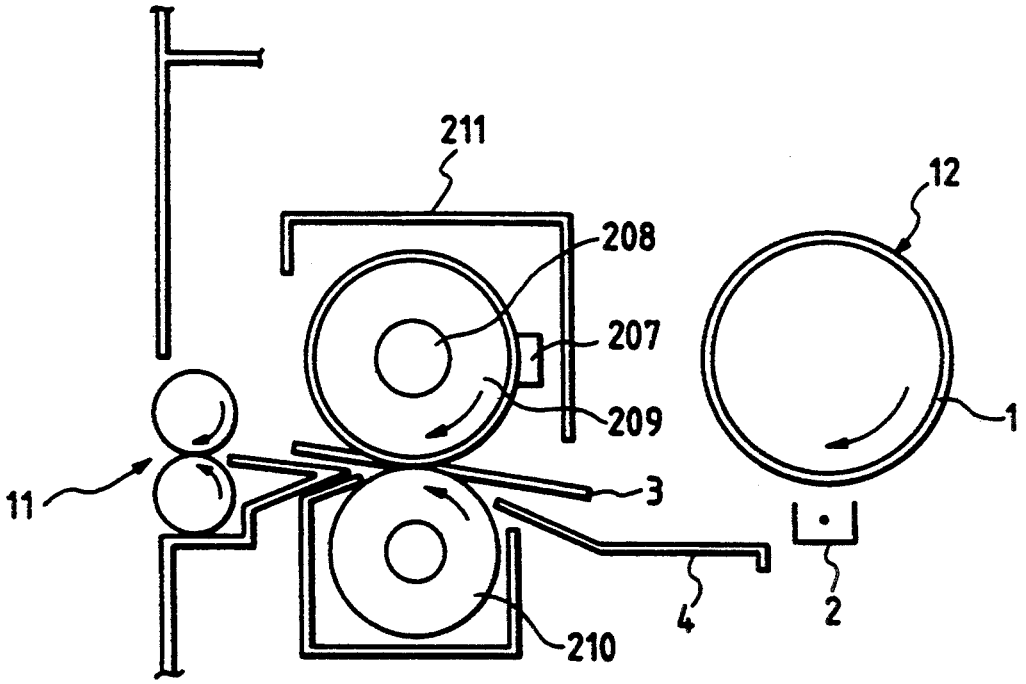
FIG. 1 is a partial cross-sectional view of an image forming apparatus employing a fixing device of an embodiment according to the present invention.

FIG. 1 is a partial cross-sectional view of an image forming apparatus employing a fixing device of an embodiment according to the present invention.

In FIG. 1, a photosensitive drum 1 can rotate as indicated by an arrow. Around the periphery of the photosensitive drum 1, a primary charger device, an exposure device, a developer device and a cleaning device (which are not shown) are provided. These devices, together with a transfer charger device 2, constitute an image forming unit 12. The photosensitive drum is uniformly charged by the primary charger device, and then an image is exposed by the exposure device to form an electrostatic latent image on its surface. This electrostatic latent image is visualized by the developer device to be from developed image. The developed image (unfixed image) is transferred from the photosensitive drum 1 onto a sheet 3 serving as the transfer medium by the transfer charger device 2 provided under the photosensitive drum 1. The sheet 3 on which the developed image has been transferred is sent through an intermediate carrier unit 4 to a fixing device 211, where the sheet 3 is adjusted to an edge portion which is a sheet feed guide. Then, the sheet is pinched and carried by the fixing device 211 while heated and pressed. As a result, the developed image is fixed on the sheet 3.

The fixing device 211 has a fixing roller 209 and a pressure roller 210, wherein the pressure roller 210 is always pressed against the fixing roller 209 by a pressure means. The fixing roller 209 is a cylindrical, hollow metal roller core bar which is made of copper, or the like and whose peripheral surface is coated with 3 to 100 μm of heat-resistant, mould-releasable resin such as PFA, PTFE, or the like. The fixing roller 209 has a heat source 208 such as a halogen heater in its hollow space. On the other hand, the pressure roller 210 is a metal roller core bar which is made of aluminum, stainless steel, copper, or the like and whose peripheral surface is coated with 2 to 10 mm of a heat-resistant elastic layer of silicone rubber, fluoro-rubber, phlorosilicone rubber, or the like. Preferably, the peripheral surface is further coated with 3 to 100 μm of a heat-resistant, mould-releasable resin layer of PFA, PTFE, or the like.

The sheet 3 supporting the unfixed toner image is guided by the fixing device 211 constructed as described above, pinched between and carried by the fixing roller 209 and the pressure roller 210, wherein said toner image is fixed on the transfer medium as a permanent image by heat from the heated fixing roller 209. The sheet 3 is pinched and discharged out of the apparatus by discharge rollers 11.

Figure 2:
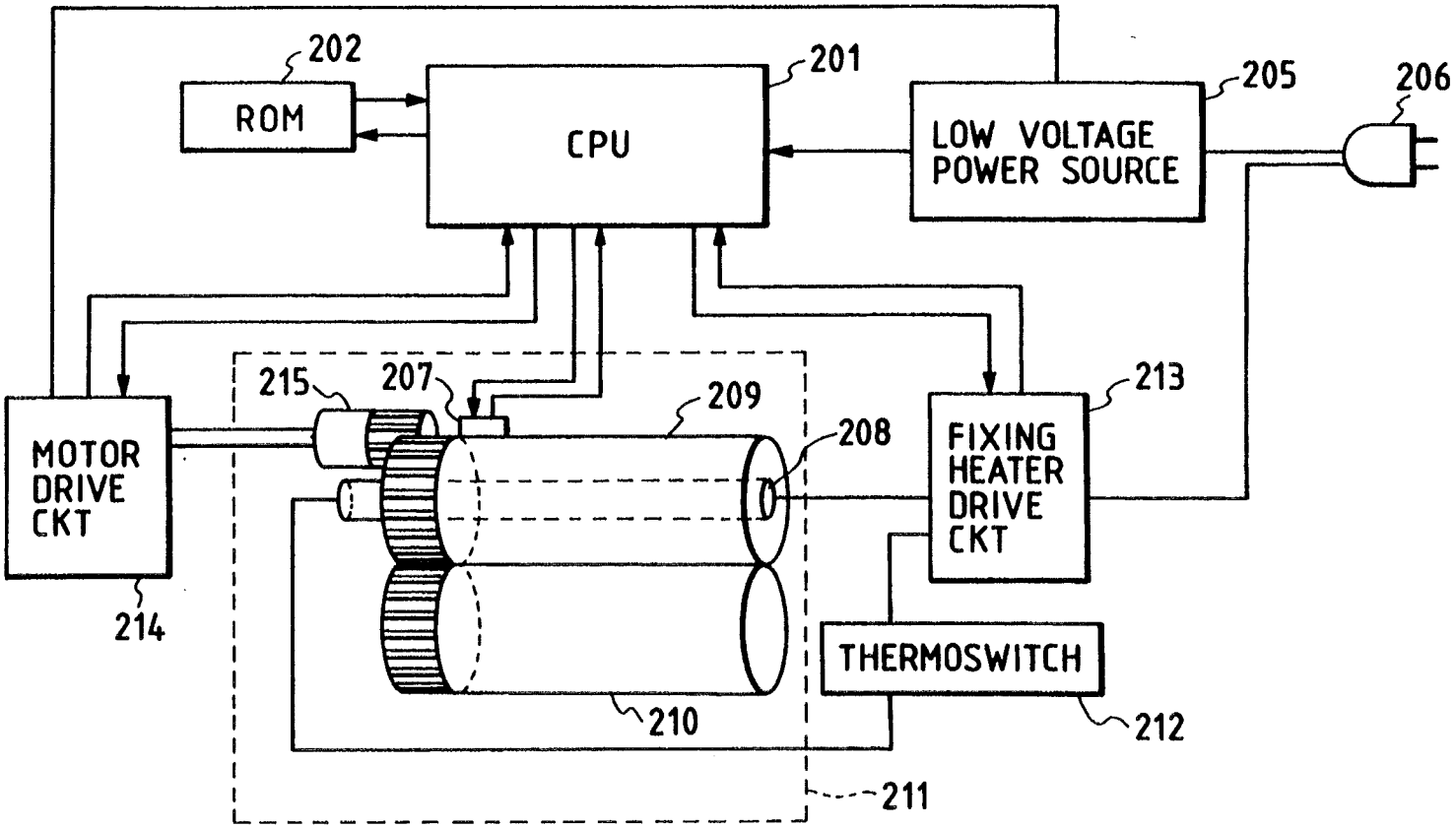
FIG. 2 is a block diagram schematically showing the constitution of an embodiment according to the present invention.

FIG. 2 is a schematic block diagram of an embodiment according to the present invention.

The fixing device 211 has the fixing roller 209 and the pressure roller 210 which is pressed against the fixing roller 209 to be driven and rotated therewith. A sheet as large as B4 can be fed to this fixing device. The fixing roller 209 contains the heater 208 (a halogen heater, rated 100 V, 665 W, in this embodiment). The heater 208 is connected with: a fixing heater drive circuit 213 which receives a signal from a CPU (central processing unit) 201 (described later) and controls heat generated by the heater 208 within a predetermined range; and a thermoswitch 212 which stops energizing when said drive circuit 213 gets out of order and causes excessive temperature rising of the fixing roller. Further, a main motor 215 for rotating the fixing roller 209 via gears, and the like in a predetermined direction is provided at the left end of the fixing roller 209. The main motor 215 is connected with a motor drive circuit 214 which receives a signal from the CPU 201 (described later) and controls rotation of the motor 215.

Next, the constitution of a control means in the fixing device of this embodiment will be described. The CPU (central processing unit) 201 serving as the control center of the control means is connected with a low voltage power source 205 for lowering commercial power source voltage applied from a plug 206. The CPU 201 is also connected with a ROM 202 serving as a recording device which stores the contents of fixing position temperature control sequence for executing heat fixing operation; and a temperature detection element (thermister) 207 which is arranged to be in contact with an end portion of a non-sheet-feed area in order to detect surface temperature of the fixing roller 209. In this embodiment, the thermister 207 is arranged to be outside the sheet feed area of the largest recording medium so as to be always in contact with the non-sheet-feed area regardless of size of the recording media.

Figure 3:
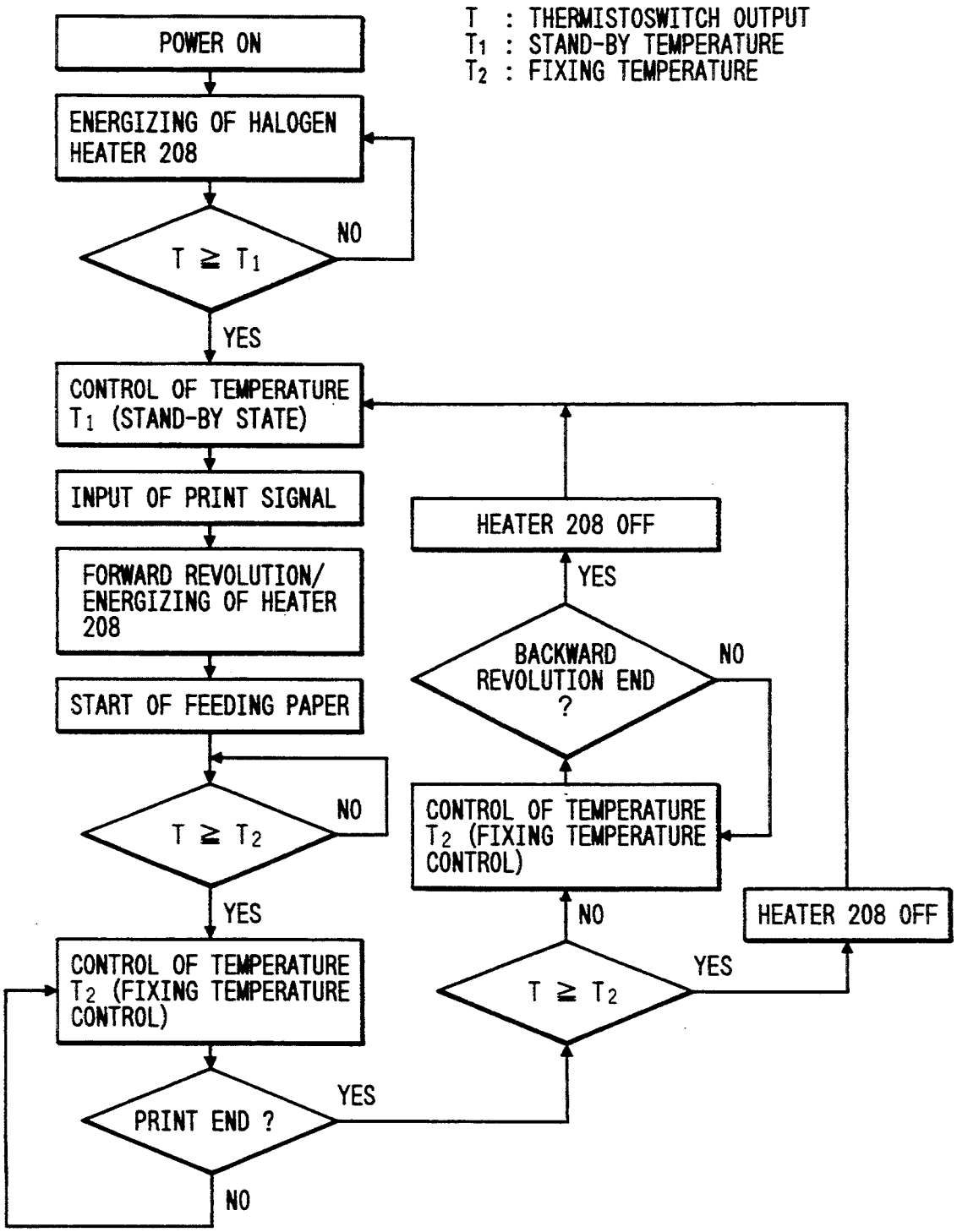
FIG. 3 is a flowchart for temperature control in the device shown in FIG. 2.
Figure 4:
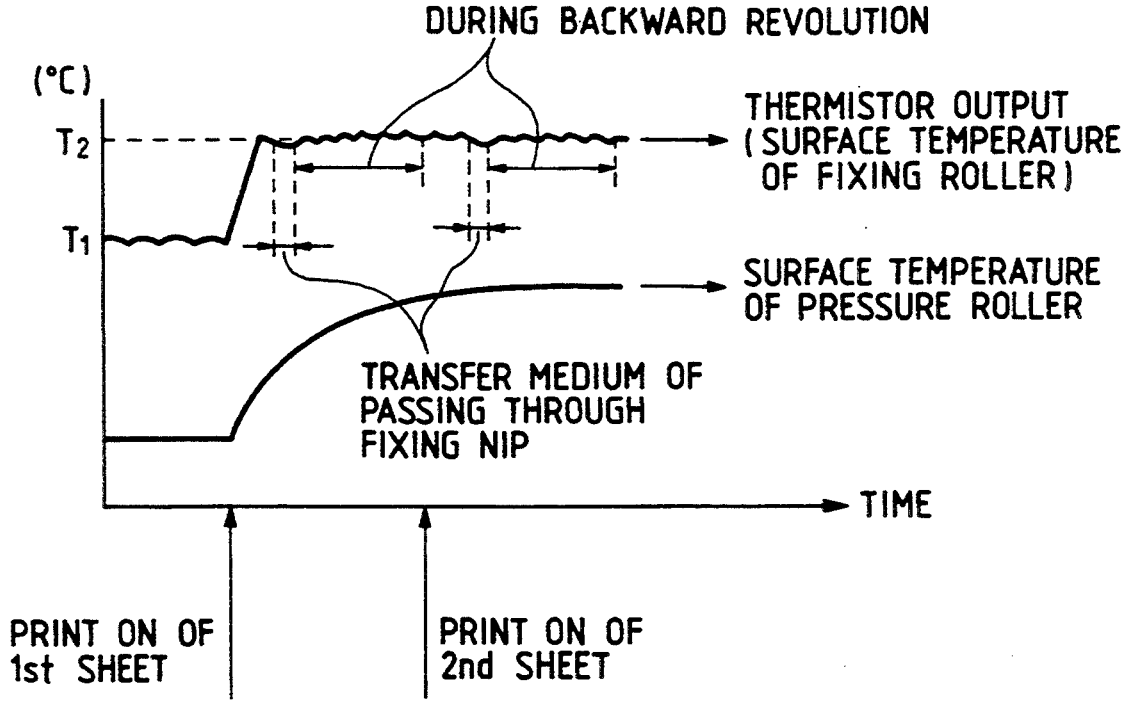
FIG. 4 is a graph showing change in output from the temperature detection means and in surface temperature of the pressure roller, when the device shown in FIG. 2 is installed in low temperature environment.

FIG. 3 is a flowchart for operation of this embodiment. When a power switch in the main body is turned on, voltage of 100 V from the plug is input to the low voltage power source, thereby starting operation of the CPU 201. First, information stored in the ROM 202 is read out. Then, the fixing device enters a stand-by state according to said information stored in the ROM 202. Subsequently, when a print signal is applied from an external apparatus such as a personal computer, the CPU 201 starts the forward revolution and energizes the halogen heater 208. Then, the CPU 201 starts feeding a transfer medium, and now controls surface temperature of the fixing roller to be $T_2$(°C.).

Next, operation after the print signal from the external apparatus is turned OFF and the print operation is finished will be described, by which the present invention is characterized. The CPU 201 reads T output from the thermistor when print operation is finished, and compares T with $T_2$. If $T \geqq T_2$, the CPU 201 turns off the heater 208 and immediately switches to control of temperature $T_1$ (stand-by state temperature control). On the other hand, if $T < T_2$, the CPU 201 continues control of temperature $T_2$ during the backward revolution, and switches to control of temperature $T_1$ after the backward revolution is over and the fixing roller 209 is stopped. Accordingly, the following effects can be obtained.

Figure 16:
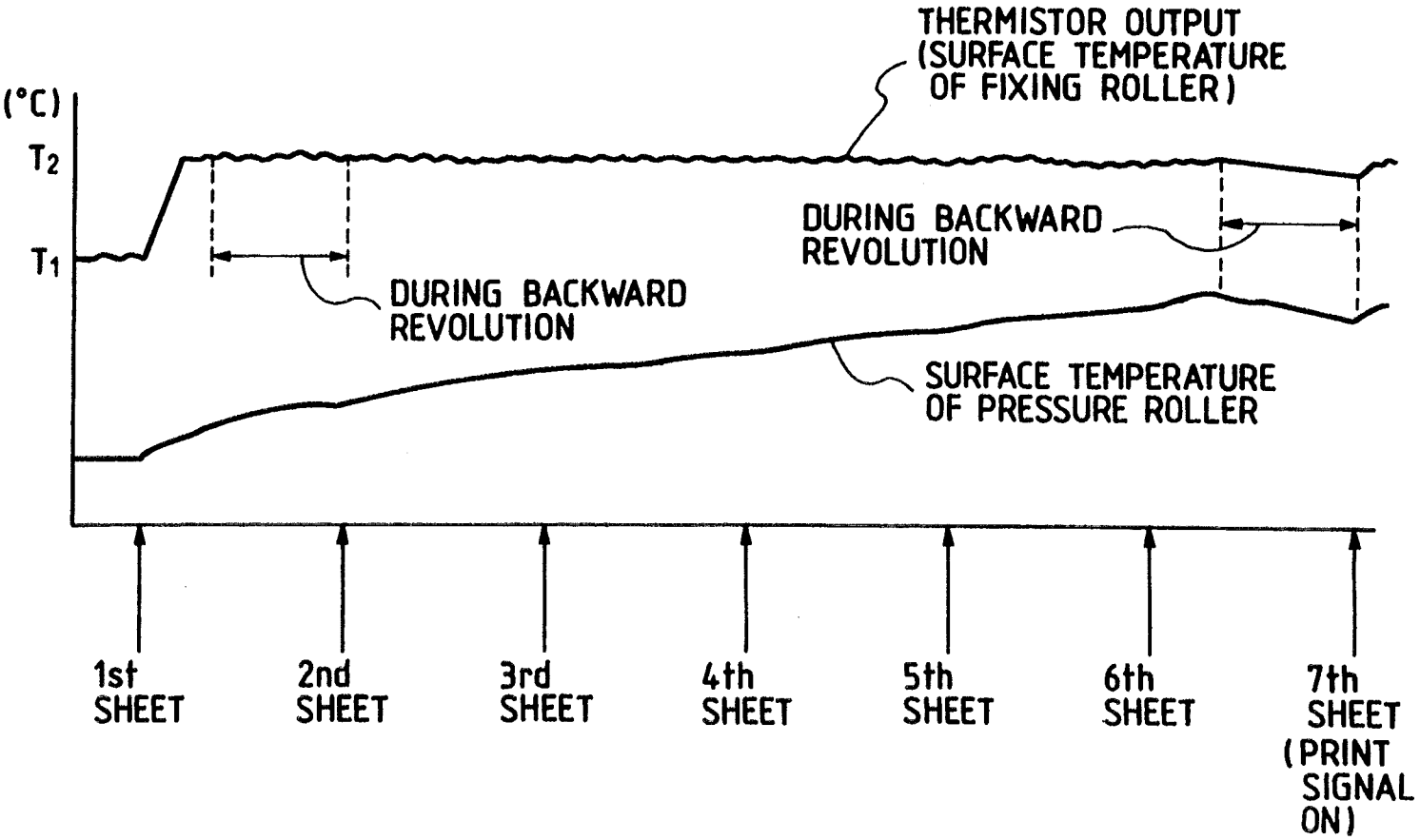
FIG. 16 is a graph showing change in output from the temperature detection means and in surface temperature of the pressure roller, when the device shown in FIG. 14 is installed in low temperature environment.
Figure 17:
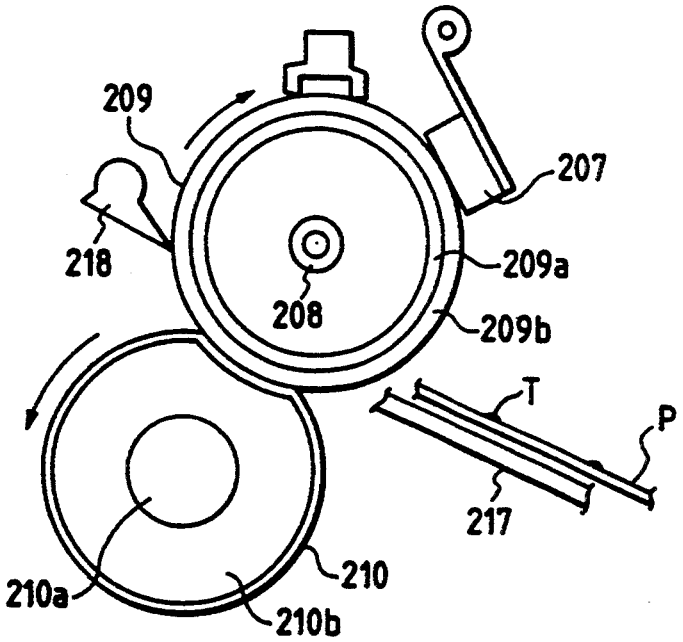
FIG. 17 PRIOR ART
FIG. 17 is a cross-sectional view schematically showing the constitution of a conventional fixing device.
Figure 19:
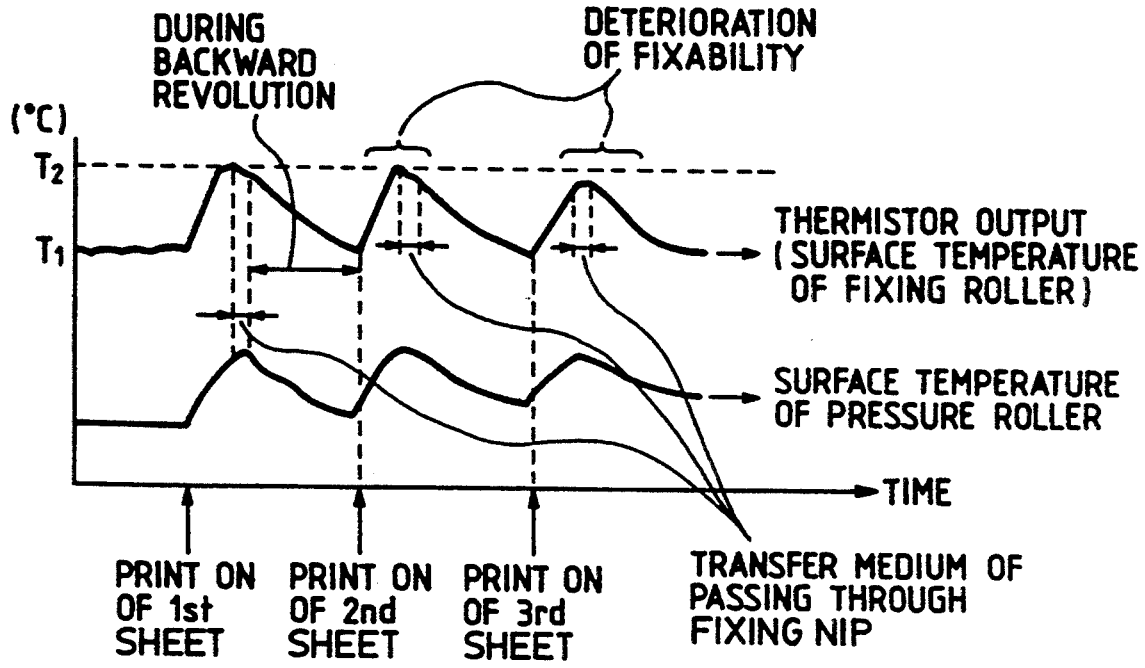
FIG. 19 PRIOR ART
FIG. 19 is a graph showing change in output from the temperature detection means and in surface temperature of the pressure roller when fixing operation is intermittently performed and temperature control of the heated member is not carried out during time when the device shown in FIG. 17 finishes the fixing operation and discharges the transfer medium.
Figure 18:
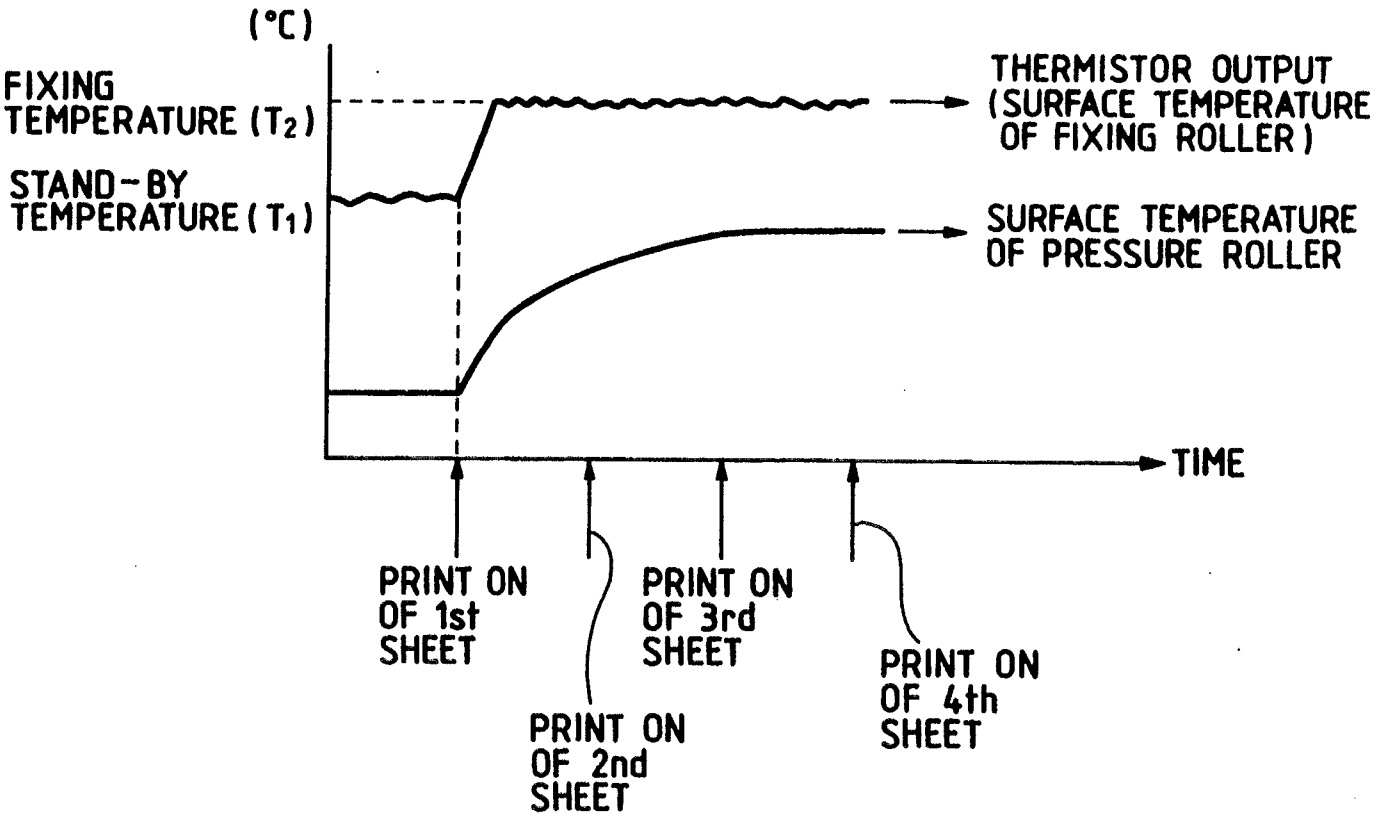
FIG. 18 PRIOR ART
FIG. 18 is a graph showing change in output from the temperature detection means and in surface temperature of the pressure roller, when the device shown in FIG. 17 performs the fixing operation continuously.
Figure 20:
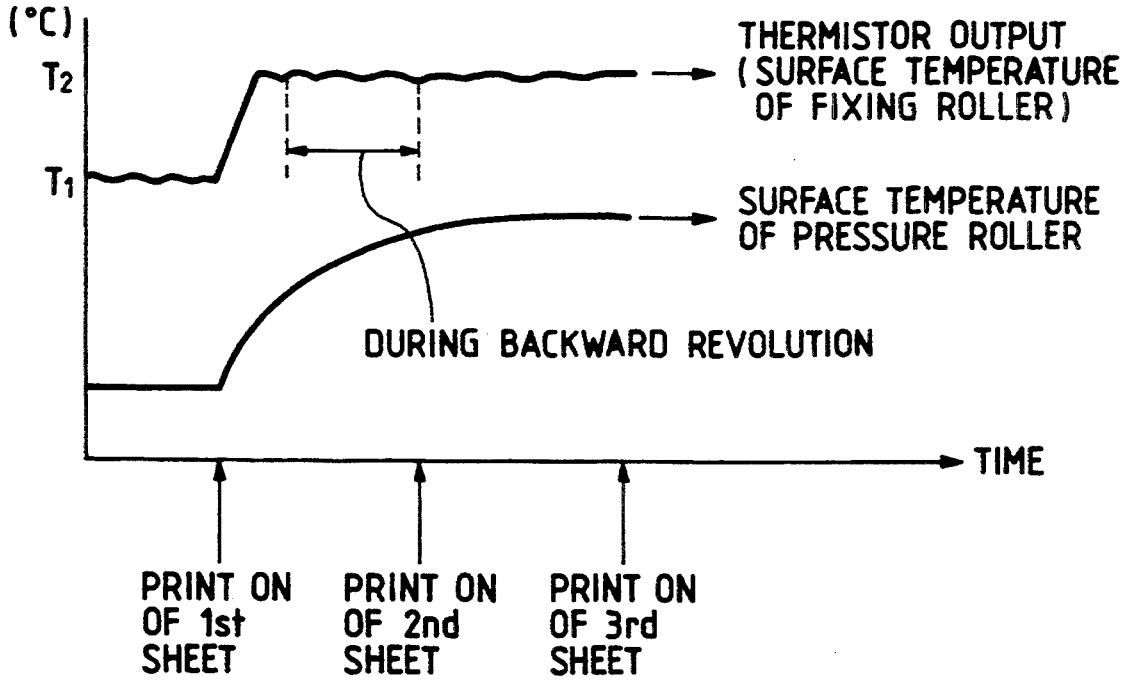
FIG. 20 PRIOR ART
FIG. 20 is a graph showing change in output of the temperature detection means and in surface temperature of the pressure roller in low temperature environment when the heated member is controlled to be at the fixing temperature during time when the device shown in FIG. 17 finishes the fixing operation and discharges the transfer medium.
Figure 21:
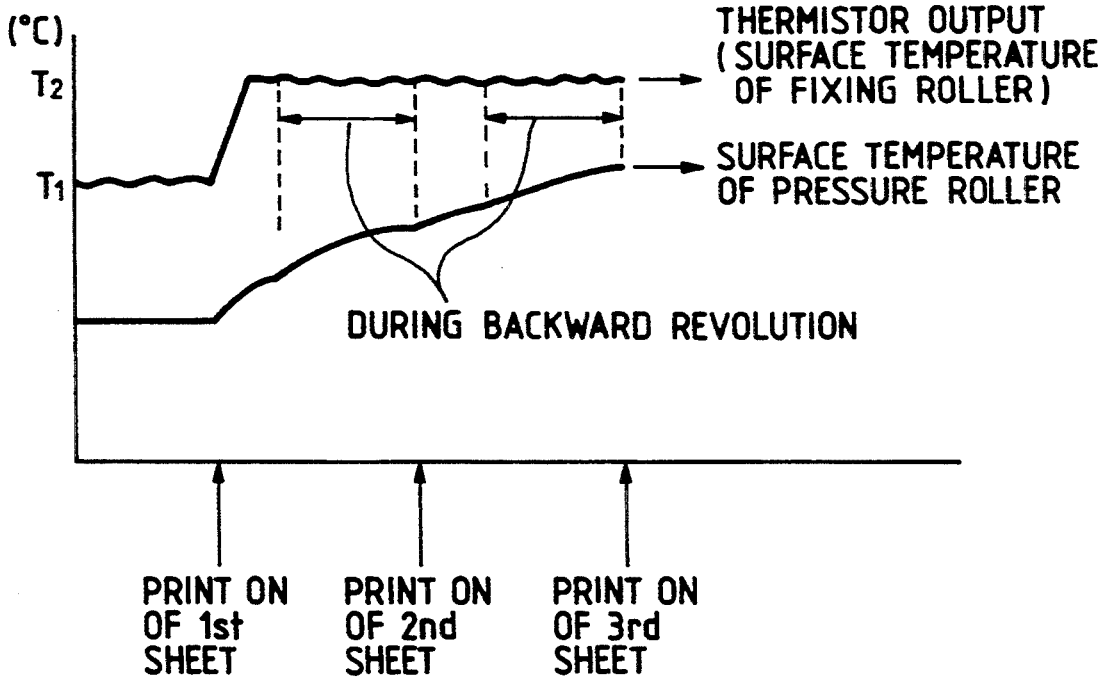
FIG. 21 PRIOR ART
FIG. 21 is a graph showing change in output from the temperature detection means and in surface temperature of the pressure roller in high temperature environment when the heated member is controlled to be at the fixing temperature during time when the device shown in FIG. 17 finishes the fixing operation and discharges the transfer medium.

1. When the apparatus is installed in a low temperature environment, and when an image having large print proportion such as a solid black image is printed on a thick sheet;

large amount of heat escapes from the fixing roller 209 to the transfer medium and the pressure roller 210. And it is highly probable that the surface temperature of the fixing roller 209 becomes lower than $T_2$ when the transfer medium comes out of the fixing position (nips position). If "$T < T_2$" is output from the thermistor, the CPU 201 continues control of temperature $T_2$ of the fixing roller 209 during the backward revolution in order to heat up the pressure roller 210. Accordingly, since the outflow of heat from the fixing roller 209 through the transfer medium to the pressure roller 210 does not occur at the time of the next image output, an excellent fixing property can be obtained as in continuous sheet feed, as shown in FIG. 16.

Figure 5:
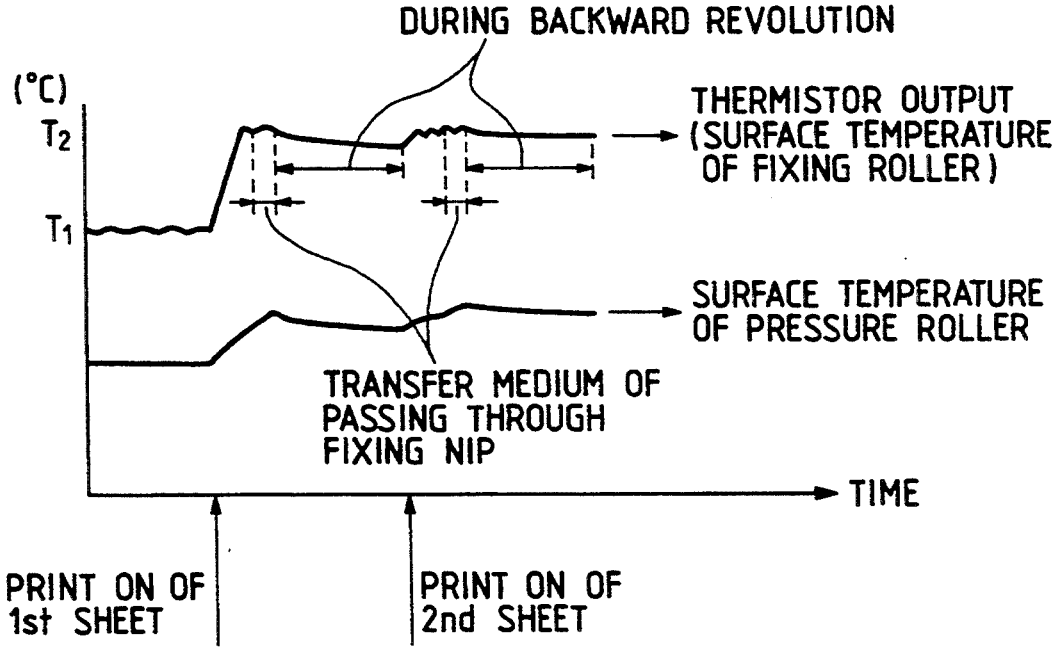
FIG. 5 is a graph showing change in output from the temperature detection means and in surface temperature of the pressure roller, when the device shown in FIG. 2 is installed in high temperature environment.

2. When the apparatus is installed in a high temperature environment, and when an image is printed on a thin sheet;

the outflow of heat from the fixing roller 209 to the transfer medium and the pressure roller 210 is reduced because temperature of the transfer medium and the pressure roller 210 has increased beyond the room temperature. Accordingly, it is highly probable that surface temperature of the fixing roller 209 is maintained within a range of control of temperature $T_2$ when the transfer medium comes out of the fixing position (nips position). And, when "$T \geqq T_2$" is output from the thermister, the CPU 201 does not energize the heater 208 during the backward revolution, and switches from control of temperature $T_2$ to control of temperature $T_1$, as shown in FIG. 5. As a result, excessive temperature rising in the atmosphere around the discharging side of the fixing device 211, as well as a curl and wrinkle of the sheet at the time of the next image output, can be prevented.

As described above, by applying the present invention, control of fixing temperature during the backward revolution can be made optimal according to the condition in which the apparatus main body is installed. Thus, both an excellent fixing property at low temperature and prevention against the curl and wrinkle of the sheet at high temperature can be realized.

Next, another embodiment of the present invention will be described with reference to FIGS. 6 to 9, where the same components as the above-mentioned embodiment are indicated by the same reference numerals, and a description thereof will be omitted.

Figure 6:
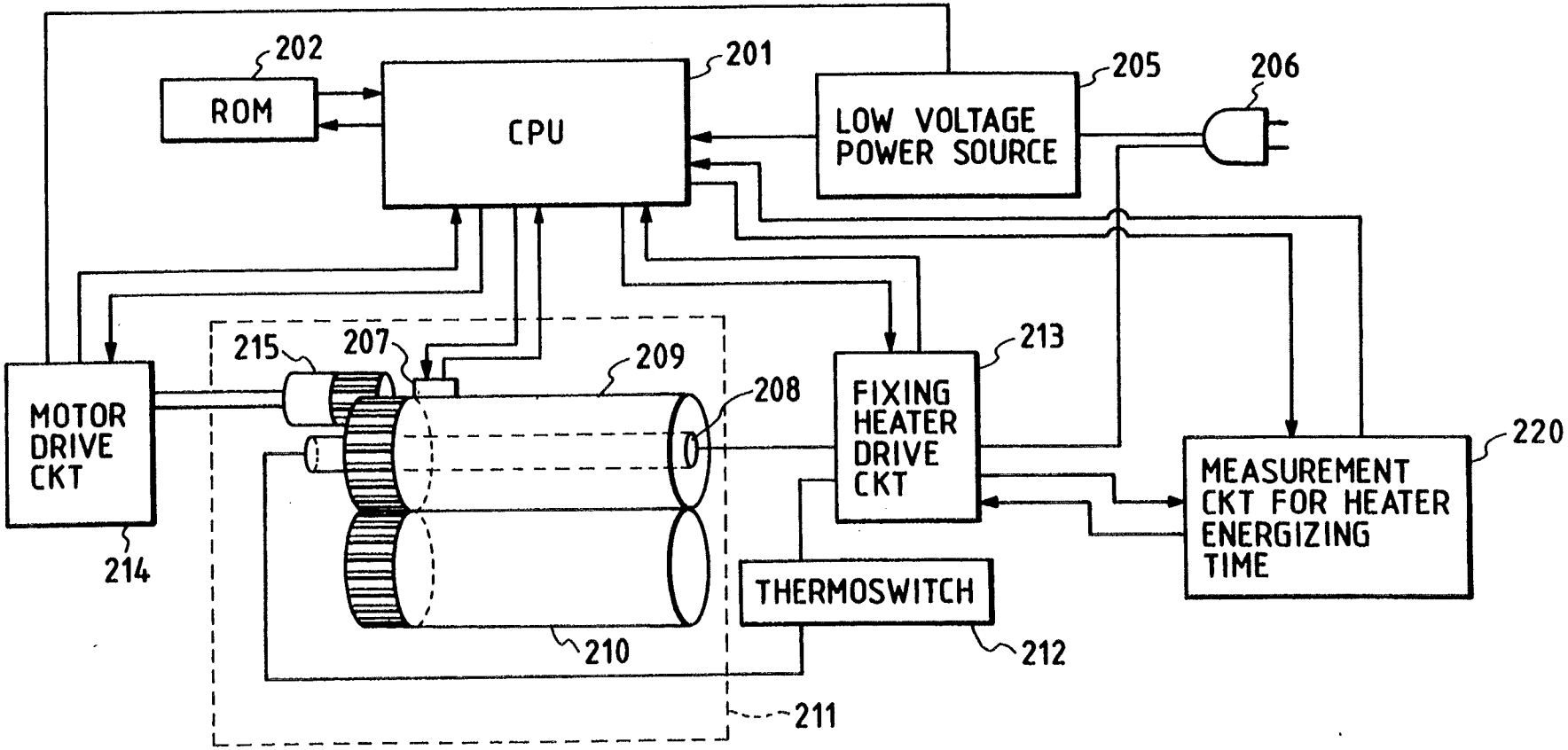
FIG. 6 is a block diagram schematically showing the constitution of another embodiment according to the present invention.
Figure 7:
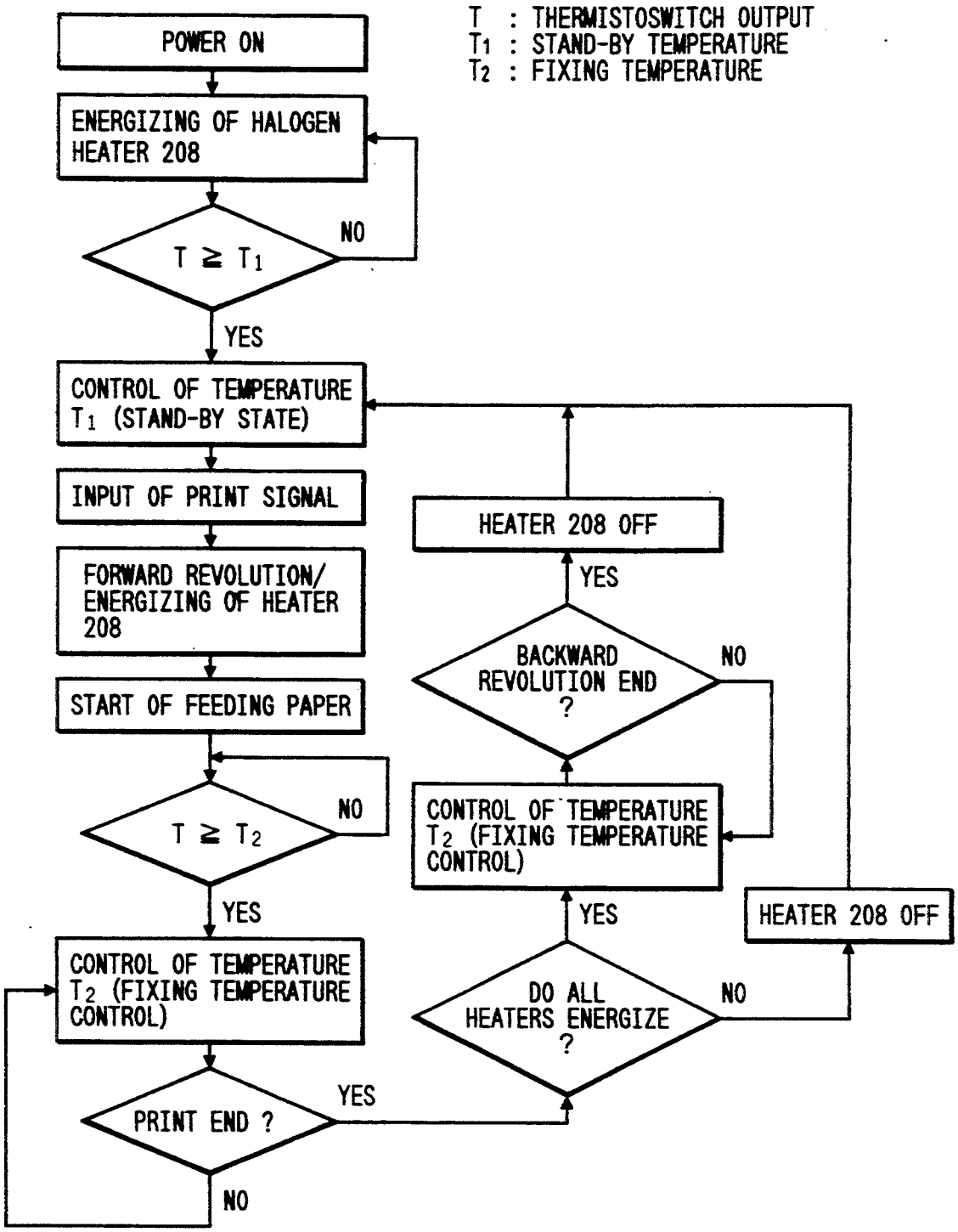
FIG. 7 is a flowchart for temperature control in the device shown in FIG. 6.

FIG. 6 is a schematic block diagram of this embodiment, and FIG. 7 is an operational flowchart of this embodiment. In this embodiment, the fixing heater drive circuit 213 is connected with a measurement circuit 220 for heater energizing time in order to measure energizing time of the halogen heater 208 during sheet feeding (that is while the transfer medium is passing through the fixing (nip position). In case of full energization of the heater, a flag (indicating full energization of the heater 208) is displayed, thereby informing the CPU 201 of the full energization. The flag is displayed only when the heater is fully energized. In this embodiment, the CPU 201 detects the flag displayed by the measurement circuit 220 for heater energizing time when print operation is over and the backward revolution starts. If the flag is not displayed, the CPU 201 immediately turns off the heater 208 and switches to control of temperature $T_1$. The rest of the operation is the same as the previous embodiment, and description thereof is omitted.

Figure 8:
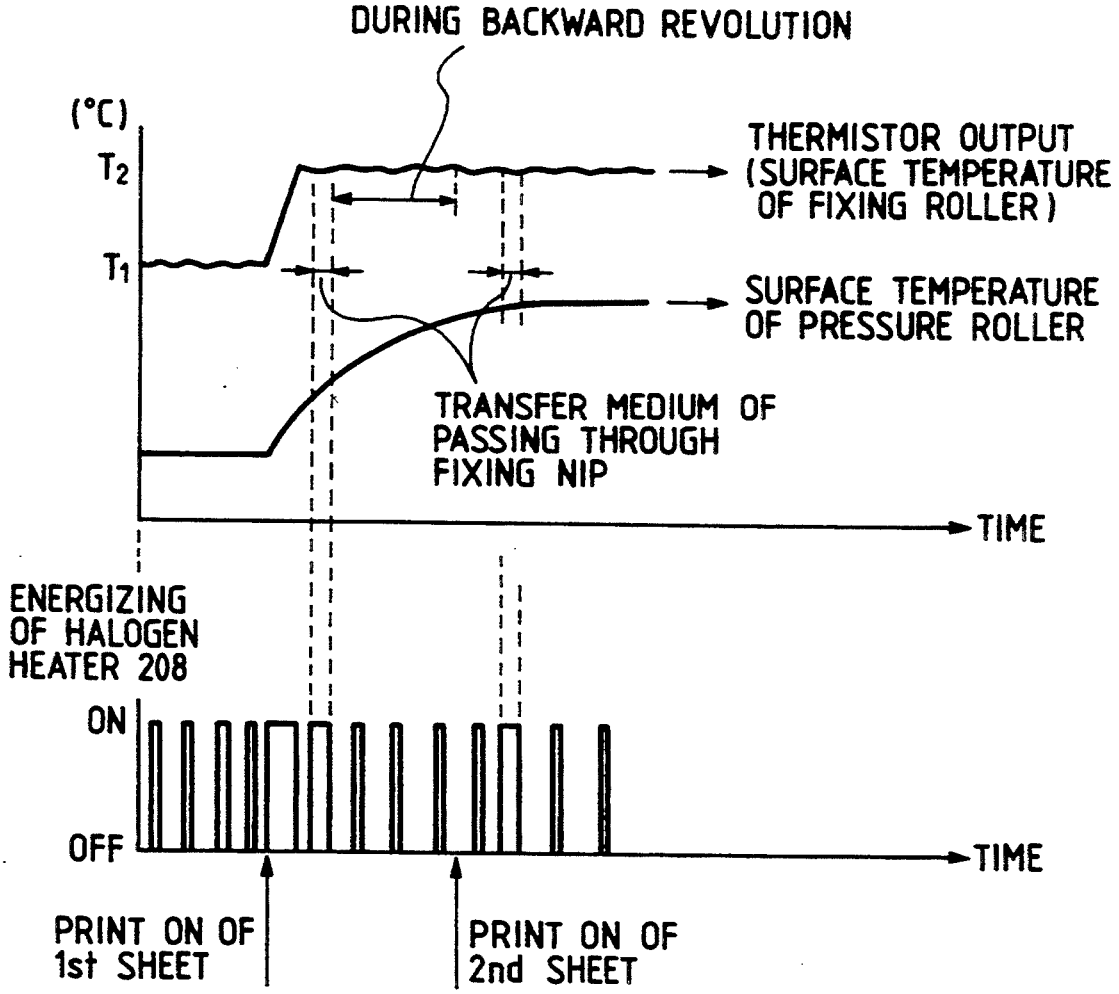
FIG. 8 is a graph showing change in output from the temperature detection means and in surface temperature of the pressure roller; and the shifting amount of the heated member, when the device shown in FIG. 6 is installed in low temperature environment.

When the apparatus main body is installed in low temperature environment, this embodiment executes the following operation. As the pressure roller 210 and the transfer medium are cooled, heat escapes from the fixing roller 209 to the pressure roller 210 and the transfer medium during sheet feeding. Therefore, the halogen heater 208 is fully energized in order to compensate for a loss of heat from the fixing roller 209, as shown in FIG. 8. As a result, the measurement circuit 220 for heater energizing time measures full energization of the halogen heater 208 and displays the flag. Thus, the CPU 201 executes control of temperature $T_2$ also during the backward revolution in order to heat up the pressure roller 210, thereby preventing surface temperature of the fixing roller 209 from falling down at the time of the next printing operation.

Figure 9:
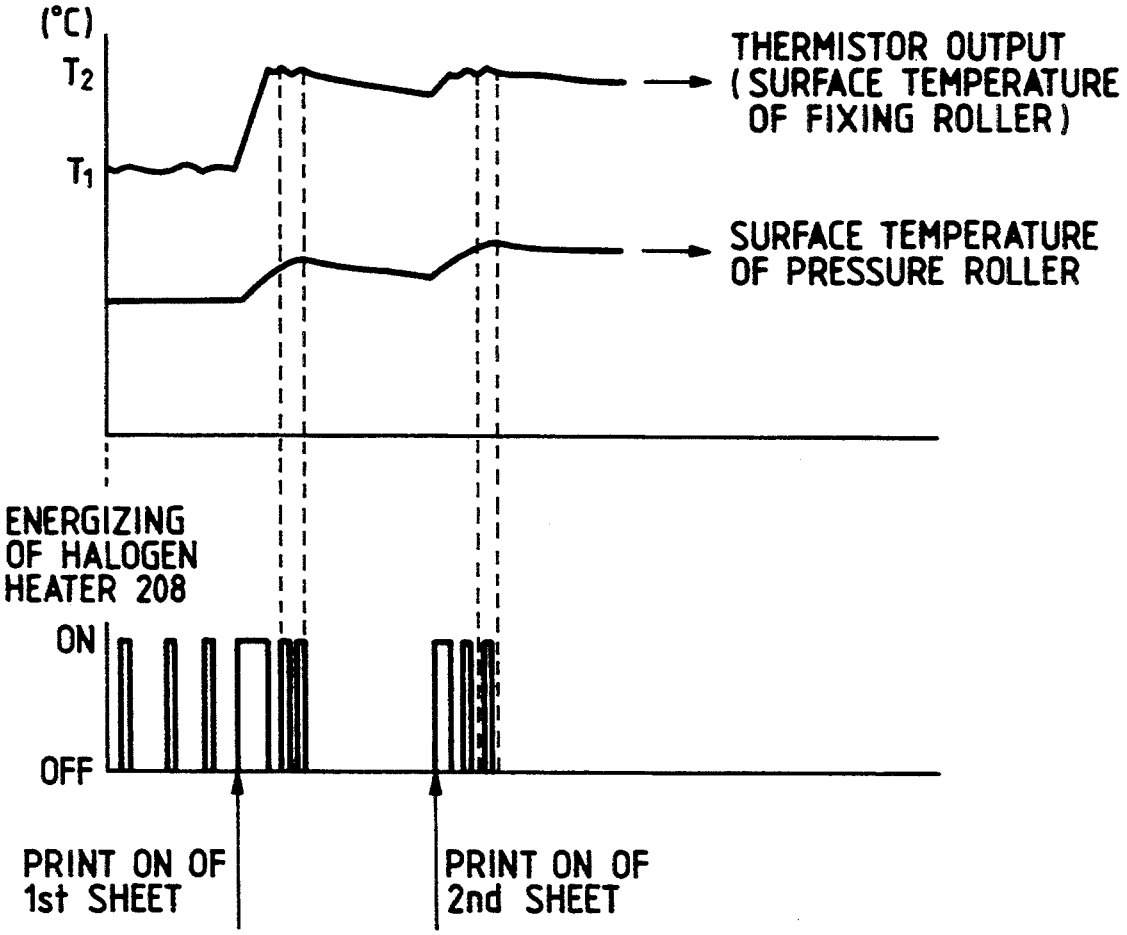
FIG. 9 is a graph showing change in output from the temperature detection means and in surface temperature of the pressure roller; and the shifting amount of the heated member, when the device shown in FIG. 6 is installed in high temperature environment.

On the other hand, when the apparatus main body is installed in a high temperature environment, as the pressure roller 210 and the transfer medium are warmed up as high as about room temperature, the outflow of heat to the pressure roller 210 and the transfer medium during sheet feeding does not occur, and there is no loss of heat from the fixing roller 209. Therefore, the fixing roller 209 can be easily controlled within the range of control of temperature $T_2$ by turning on and off the halogen heater, wherein full energization is not required, as shown in FIG. 9. As a result, the measurement circuit 220 for heater energizing time does not display the flag, and the CPU 201 switches from control of temperature $T_2$ to control of temperature $T_1$ during the backward revolution. Accordingly, excessive temperature rising in the area around the discharging side of the fixing device 211 can be prevented when the sheets are intermittently fed so that a curl and wrinkle of the sheets can be prevented.

Now, still another embodiment of the present invention will be described. The same components as the above embodiments will not be described.

Though, in the above embodiments, control of fixing temperature (control of temperature $T_2$ or control of stand-by state temperature; $T_1$) is executed during the backward revolution, temperature control during the backward revolution is not limited to those, but control of temperature $T_3$ ($T_3>T_2$) and control of temperature $T_4$ ($T_1<T_4<T_2$) may be executed. Further, if suitable for the characteristics of the apparatus, temperature control may be switched to multistep control during the backward revolution.

Figure 10:
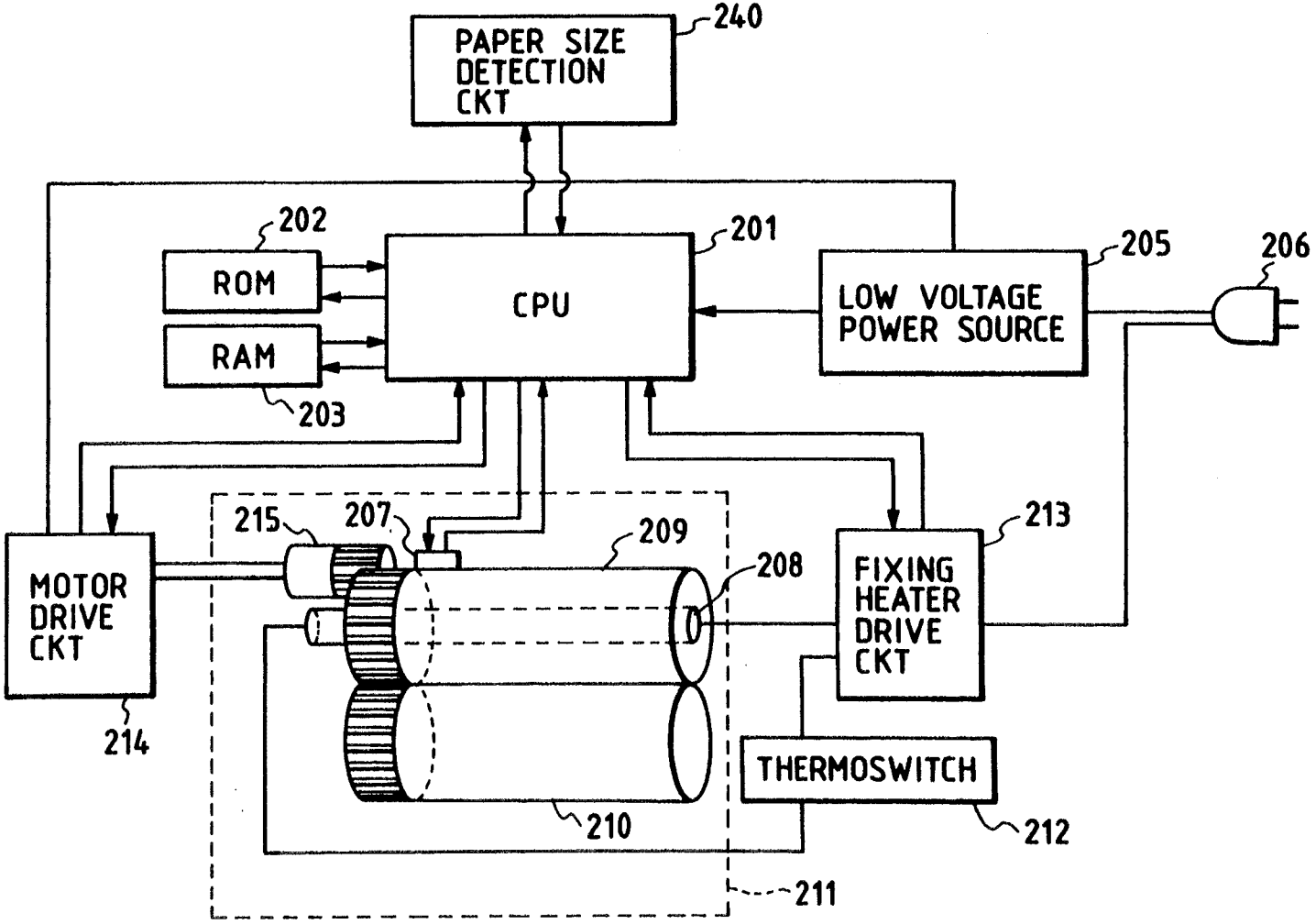
FIG. 10 is a block diagram schematically showing constitution of a device of still another embodiment according to the present invention.

Next, a still further embodiment of the present invention will be described with reference to FIGS. 10 to 13. FIG. 10 is a schematic block diagram of this embodiment, wherein only the fixing device by which the present invention is clearly characterized is shown and other components: image forming unit, sheet feed unit, sheet carrier unit, drive unit, and so on, are not shown.

In FIG. 10, the fixing device 211 has the fixing roller 209 and the pressure roller 210 which is pressed against the fixing roller 209 to be driven and rotated therewith. A sheet as large as A3 paper can be fed to this fixing device. The fixing roller 209 contains the heater 208 (a halogen heater, rated 100 V, 665 W, in this embodiment). The heater 208 is connected with: the fixing heater drive circuit 213 which receives a signal from a CPU (central processing unit) 201 (described later) and controls heat generated by the heater 208 within a predetermined range; and the thermoswitch 212 which stops energizing when said drive circuit 213 gets out of order and causes excessive temperature rising of the fixing roller. Further, the main motor 215 for rotating the fixing roller 209 via gears, and so on in a predetermined direction is provided at the left end of the fixing roller 209. The main motor 215 is connected with the motor drive circuit 214 which receives a signal from the CPU 201 and controls rotation of the motor 215.

Next, the constitution of a control means in the fixing device of this embodiment will be described. The CPU (central processing unit) 201 serving as the control center of the control means is connected with the low voltage power source 205 for lowering commercial power source voltage applied from the plug 206. The CPU 201 is also connected with: the ROM 202 serving as a recording device which stores the contents of fixing area temperature control sequence for executing heat fixing operation; a sheet size detection circuit 240 for detecting sheet size; a RAM 203 for primary storage of sheet size data; and the temperature detection element (thermistor) 207 which is arranged to be in contact with the end portion of the non-sheet-feed area in order to detect surface temperature of the fixing roller 209. In this embodiment, the thermistor 207 is arranged to be outside the sheet feed area of the largest recording medium so as to be always in contact with the non-sheet-feed area regardless of the size of the recording media.

Figure 11:
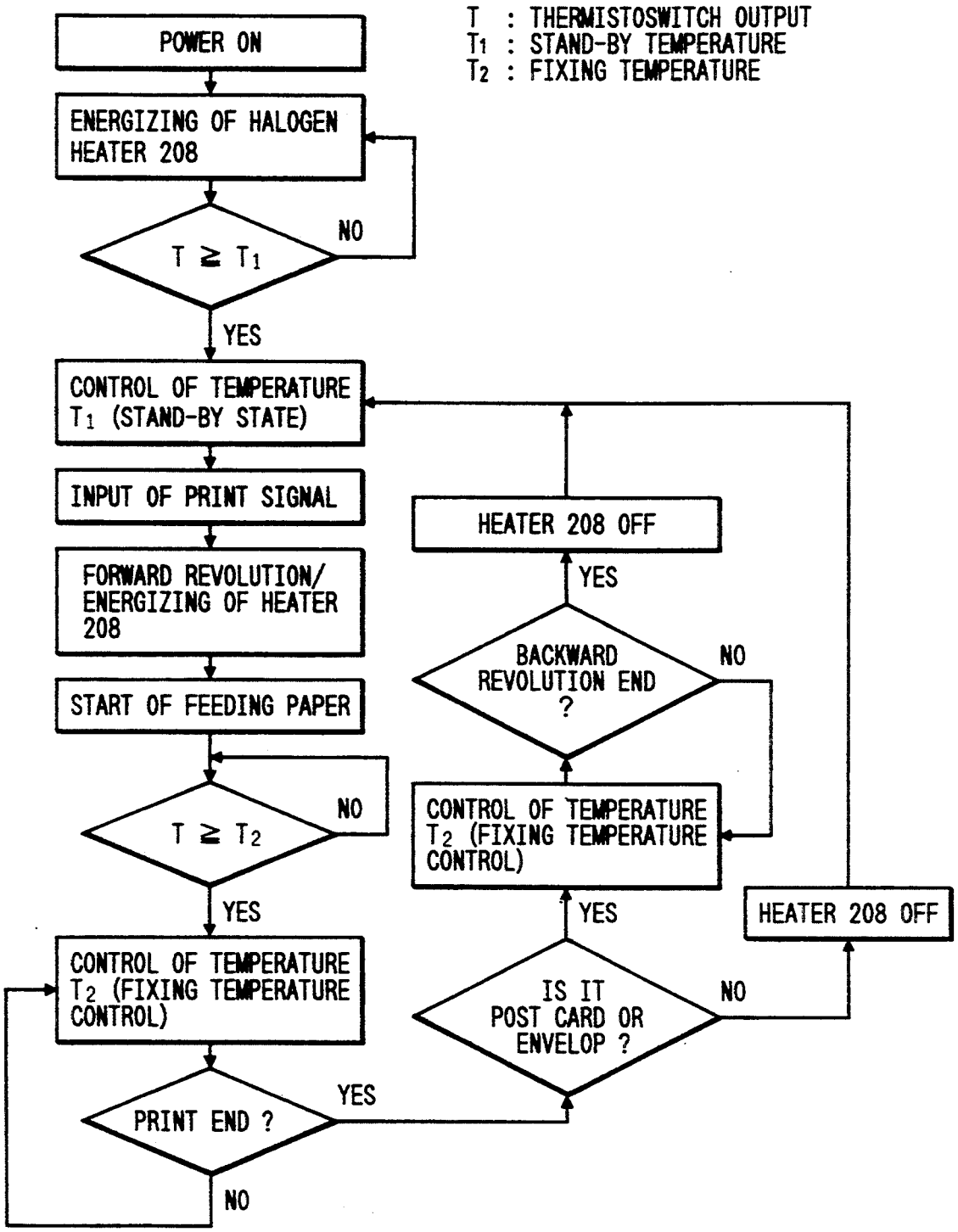
FIG. 11 is a flowchart for temperature control in the device shown in FIG. 10.
Figure 12:
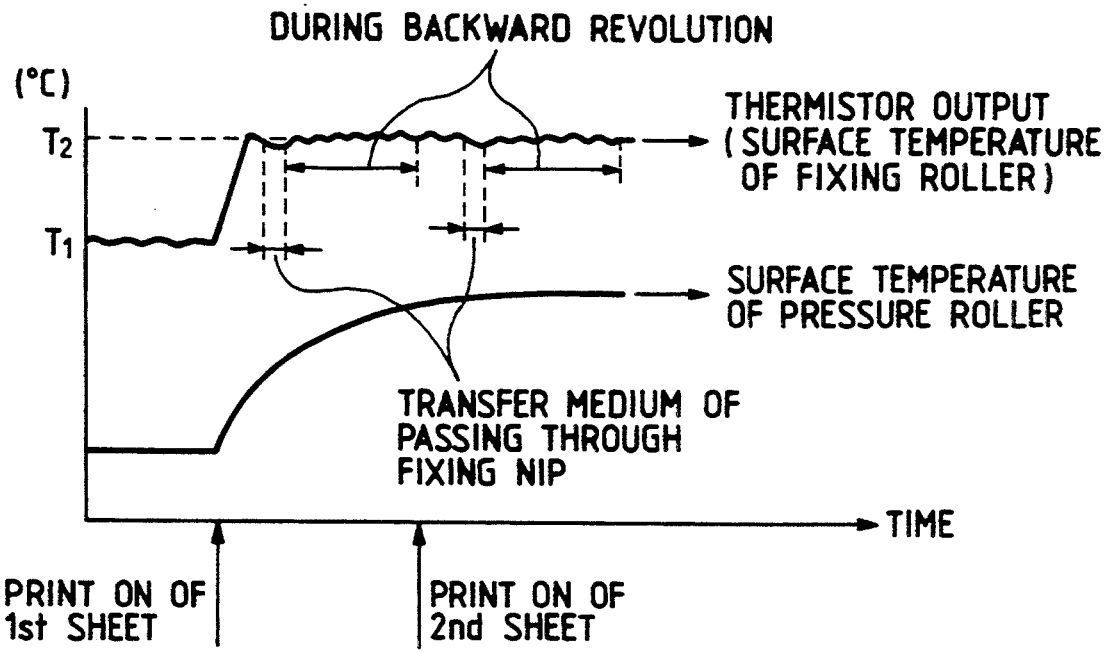
FIG. 12 is a graph showing change in output from the temperature detection means and in surface temperature of the pressure roller, when the device shown in FIG. 10 is installed in low temperature environment.

FIG. 11 is a flowchart for operation of this embodiment. When the power switch in the main body is turned on, voltage of 100 V from the plug is inputted to the low voltage power source, thereby starting the operation of the CPU 201. First, information stored in the ROM 202 is read out. Then, the fixing device enters a stand-by state according to said information stored in the ROM 202. Subsequently, when a print signal is applied from the external apparatus such as a personal computer, the CPU starts the forward revolution and energizes the halogen heater 208. Then, the CPU 201 reads out sheet size from the sheet size detection circuit 240, stores the sheet size data in the RAM 203, and starts feeding the transfer medium. Then, the CPU controls surface temperature of the fixing roller to be $T_2$(°C.); fixing temperature.

Next, operation after the printing signal from the external apparatus is turned OFF and the print operation is finished will be described, by which the present invention is characterized. When print operation is finished, the CPU 201 reads out the sheet size data which was obtained from the sheet size detection circuit 240 from the RAM 203. If sheet size is that of a postcard or an envelope, the CPU 201 continues control of temperature $T_2$ during the backward revolution, and switches to control of temperature $T_1$ after the backward revolution is over and the fixing roller 209 is stopped.

On the other hand, if the sheet size is different from those of a postcard and an envelope (for example, A4, B4, A3, or the like), the CPU turns off the heater 208 and immediately switches to control of temperature $T_1$ (stand-by state temperature control) .

Accordingly, the following effects can be obtained.

1. When the apparatus is installed in a low temperature environment, and when an image having a large print proportion such as a graphic image is printed on a postcard or an envelope;
   large amount of heat escapes from the fixing roller 209 to the transfer medium and the pressure roller 210. And it is highly probable that surface temperature of the fixing roller 209 becomes lower than $T_2$ when the transfer medium comes out of the fixing position (nip position). But, as the sheet size data read at the end of the printing operation indicates sheet size of a postcard or an envelope, the CPU 201 continues control of temperature $T_2$ of the fixing roller 209 during the backward revolution in order to heat up the pressure roller 201. Accordingly, since the outflow of heat from the fixing roller 209 through the transfer medium to the pressure roller 210 does not occur at the time of the next image output, the excellent fixing property can be obtained as in continuous sheet feed and in thin sheet feed, as shown in a FIG. 12.
2. When the apparatus is installed in high temperature environment, and when an image is printed on a normal sheet of A4, B4, A3, and the like;
   the outflow of heat from the fixing roller 209 to the transfer medium and the pressure roller 210 is reduced because the temperature of the transfer medium and the pressure roller 210 has gone up beyond room temperature, and because the transfer sheet is a thin sheet having smaller base weight than a postcard and an envelope. Accordingly, it is highly probable that the surface temperature of the fixing roller 209 is maintained within the range of control of temperature $T_2$ when the transfer medium comes out of the fixing position (nip position).

Figure 13:
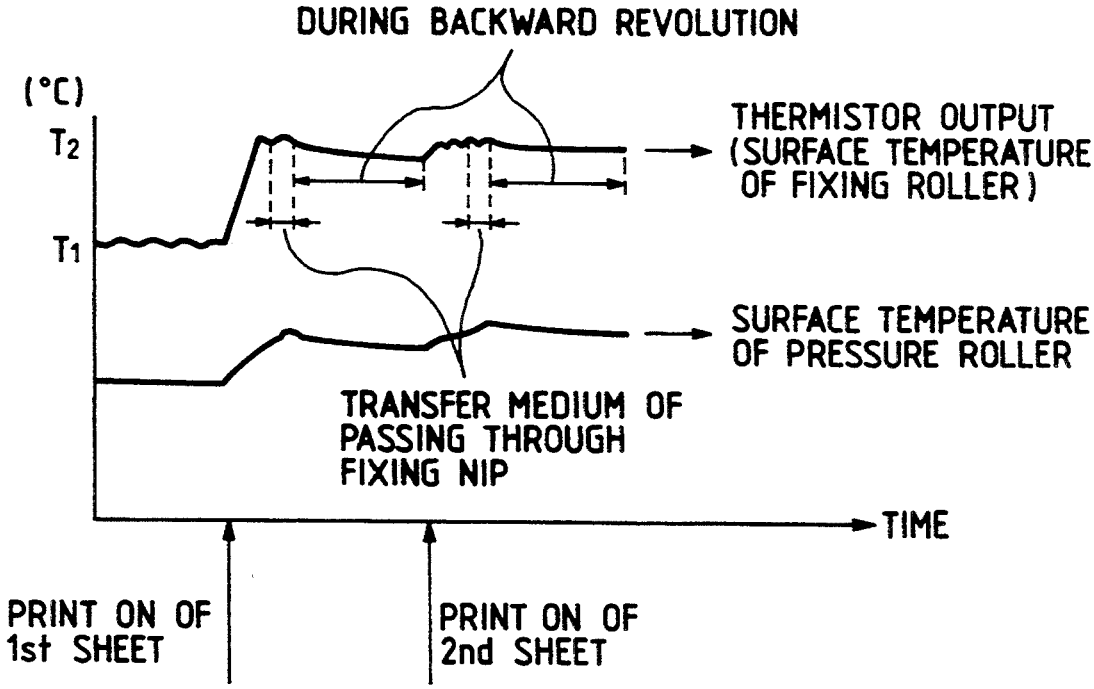
FIG. 13 is a graph showing change in output from the temperature detection means and in surface temperature of the pressure roller, when the device shown in FIG. 10 is installed in high temperature environment.

If control of temperature $T_2$ is continued during the backward revolution, excessive temperature rising in the atmosphere around the discharge portion of the fixing device 211 would occur. According to the present invention, however, since sheet side data read at the end of the printing operation indicates the sheet size of a postcard or an envelope, the CPU 201 does not energize the heater 208 during the backward revolution, and switches from control of temperature $T_2$ to control of temperature $T_1$, as shown in FIG. 13.

As a result, excessive temperature rise in the atmosphere around the discharging side of the fixing device 211, as well as a curl and wrinkle of the sheet at the time of the next image output, can be prevented.

As described above, by applying the present invention, control of fixing temperature during the backward revolution can be made optimal according to the size of the transfer sheets. Thus, both the excellent fixing property of a postcard and an envelope at low temperature and prevention against the curl and wrinkle of the thin sheet at high temperature can be realized.

Next, still another embodiment of the present invention will be described with reference to FIGS. 14 to 16, where the same components as the previous embodiment are indicated by the same reference numerals, and a description thereof will be omitted.

Figure 14:
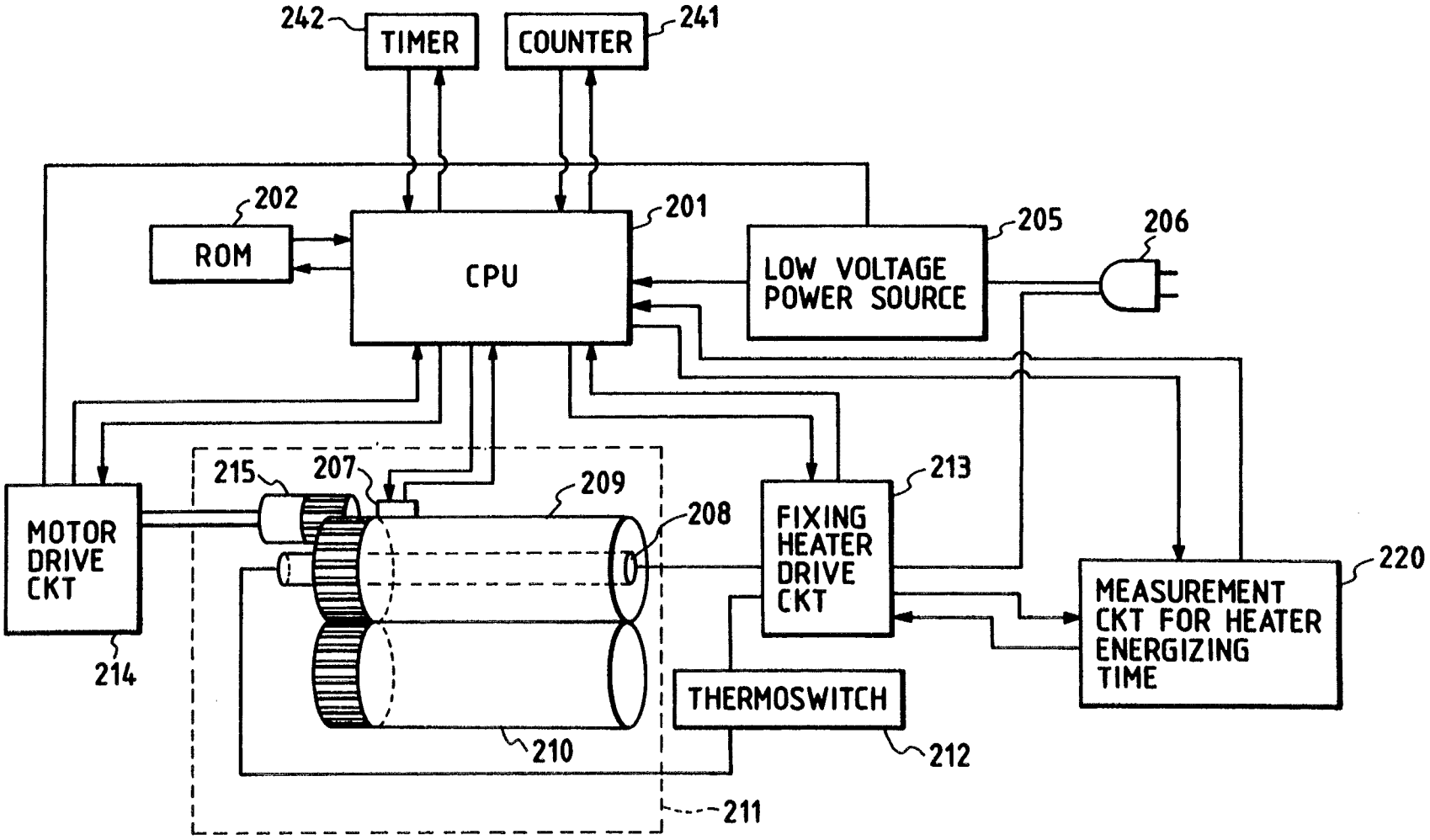
FIG. 14 is a block diagram schematically showing the constitution of a device of a still further embodiment according to the present invention.
Figure 15:
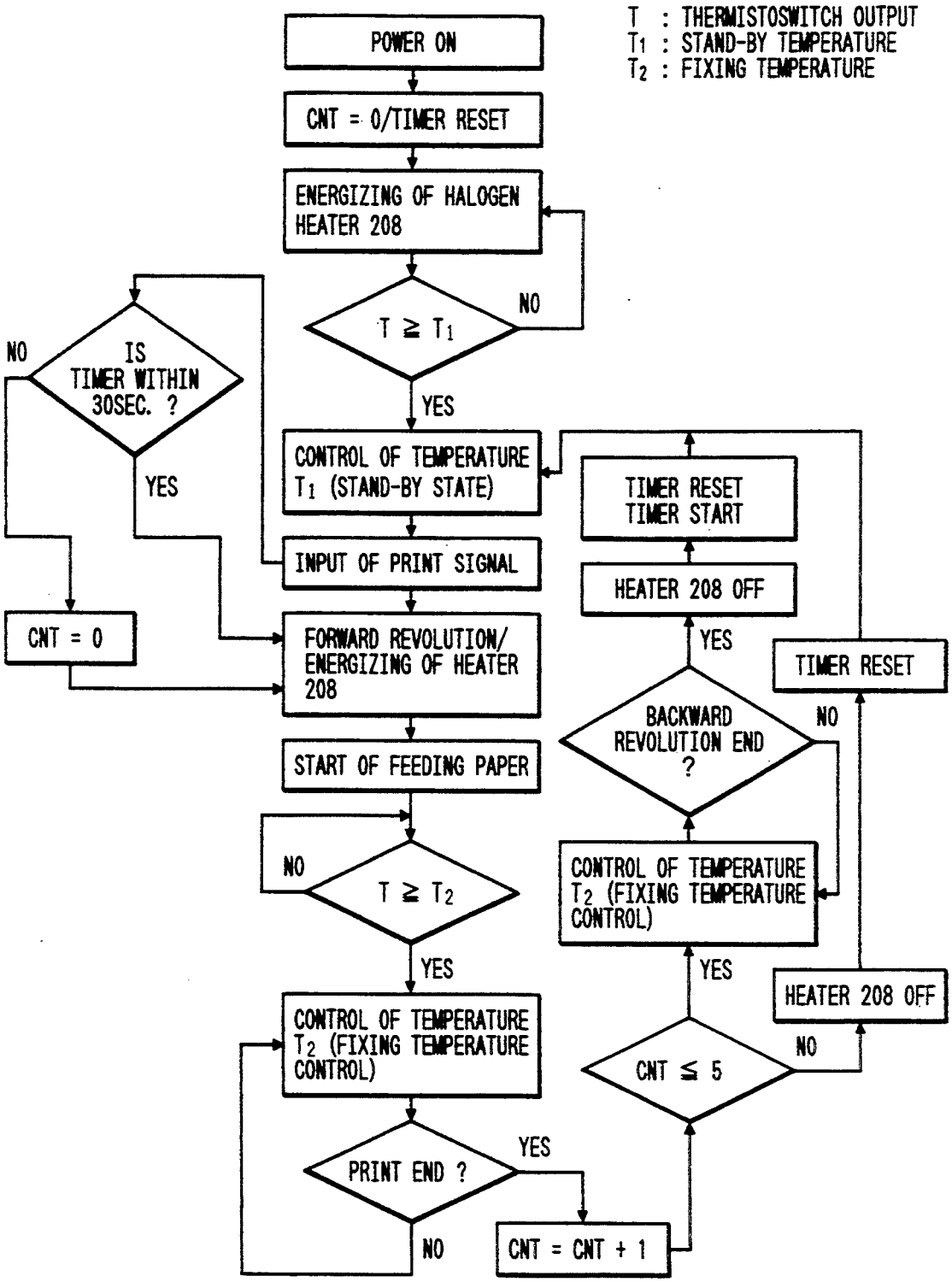
FIG. 15 is a flowchart for temperature control in the device shown in FIG. 14.

FIG. 14 is a schematic block diagram of this embodiment. FIG. 15 is a flowchart for operation of the present invention. In this embodiment, the CPU 201 is connected with: a counter 241 for counting the number of fed transfer sheets; and a timer 242 which starts after the backward revolution. The counter 241 starts counting one by one when the printing operation is over and the backward revolution is started. If a predetermined time lapse (30 seconds in this embodiment) passes after the fixing roller 209 is stopped without a newly applied print signal, that is, if the timer 242 counts more than 30 seconds, the counter 241 is to be reset.

This embodiment will be further described with reference to the operational flowchart in FIG. 15. When the power switch in the main body is turned on and voltage of 100 V from the plug 206 is applied to the low voltage power source 205, the CPU 201 starts operation and resets the counter 241 and the timer 242. Then, the CPU reads information stored in the ROM 202. The fixing device 211 enters a stand-by state according to said information stored in the RAM 202. Subsequently, when a print signal is applied from the external apparatus such as the personal computer, the CPU 201 reads the time counted by the timer 242. In this case, as the time counted by the times 242 is 0 second, the forward revolution is immediately started and the halogen heater 208 is energized. Next, the CPU 201 starts feeding the transfer sheet. And the CPU 201 controls surface temperature of the fixing roller 209 to be $T_2$(°C.).

When the print signal from the external apparatus turned OFF and the printing operation is over, the CPU advances the value of the counter 241 by one. Then, the CPU 201 checks the value of the counter 241. If it is not greater than 5, control of temperature $T_2$ is continued during the backward revolution. And after the backward revolution stops, the timer 242 is reset and started again. If the value is greater than 5, the CPU 201 turns off the heater 208, switches from control of temperature $T_2$ to control of temperature $T_1$, and resets the timer 242. In this case, the timer 242 is not started.

If the next print signal is applied after more than 30 seconds have passed since the backward revolution is finished, the counter 241 is reset, and control of temperature $T_2$ is continued during the backward revolution. In the case where the value of the counter 241 is not greater than 5, even if a print signal is applied within 30 seconds after the backward revolution is over, control of temperature $T_2$ is continued. With the above-mentioned constitution, the following effects can be obtained.

1. When sheets are intermittently fed (where the next print signal is applied within 30 seconds after the backward revolution is over);
   at the time of the printing operation of the first to fifth sheet, control of temperature $T_2$ is performed during the backward revolution to heat up the pressure roller 210, thereby reducing the outflow of heat from the transfer sheet to the pressure roller 210 during sheet feed and improving the fixing property. Said effect is remarkable especially when a thick sheet is fed. Since surface temperature of the pressure roller 210 has gone up until the printing operation of the sixth sheet, the heater 208 is then turned off during the backward revolution, as shown in FIG. 16.
2. When sheets are intermittently fed in a high temperature environment;
   at the time of the printing operation of the first to fifth sheets, control of temperature $T_2$ is performed during the backward revolution. But, as temperature rising of the pressure roller 210 is small during the printing operation of the first to fifth sheets, excessive temperature rising in the atmosphere around the discharging portion of the fixing device 211 does not occur. During and after the printing operation of the sixth sheet, surface temperature of the pressure roller 210 goes up considerably. So, the heater 208 is turned off during the backward revolution to prevent excessive temperature rise in the atmosphere around the discharge portion of the fixing device 211. Thus, curling and wrinkling thin sheets can be prevented.

As described above, also in this embodiment as in the previous embodiment, improvement of the fixing property of a thick sheet in low temperature environment and prevention against a curl and wrinkle of a thin sheet in high temperature environment can be realized. Though, in this embodiment, temperature control during the backward revolution is switched before the printing operation of the sixth sheet is started, timing of switch of temperature control can be determined according to constitution of the pressure roller 210.

Now, a still further embodiment of the present invention will be described. The same components as the above embodiments will not be described.

Though, in the previous two embodiments, control of the fixing temperature (temperature $T_2$) or control of the stand-by state temperature (temperature $T_1$) is carried out during the backward revolution, temperature control during the backward revolution is not limited to those described above, but control of temperature $T_3$ ($T_3>T_2$) and control of temperature $T_4$ ($T_1<T_4<T_2$) may be employed. Further, if suitable for the characteristics of the apparatus, temperature control may be switched to multistep control driving the backward revolution.

Next, still another embodiment of the present invention will be described. Description of the same components will be omitted.

Though, in one of the above embodiments, the timer 242 controls the counter 241, the counter 241 may be controlled according to an output value of the thermistor 207. For example, in the above embodiments, as shown in FIG. 15, the counter 241 is reset if the value of the timer 242 is greater than 30 seconds after input of the print signal. Instead, the counter may be reset if output T of the thermistor is equal to $T_1$, while the value of the counter 241 is not cleared if output T of the thermistor is different from $T_1$. The reason why such a constitution is possible is that surface temperature of the fixing roller 209 does not fall down soon after the backward revolution is over. Accordingly, when sheets are continuously but intermittently fed, output T of the thermistor is not equal to $T_1$, where the counter 241 continues to count. And after the apparatus has been left unused for a long time, output T of the thermistor is equal to $T_1$, where the counter 241 is reset.

The above description of the embodiments of the present invention is not intended to set any limitation to the present invention, but the present invention also includes all the variations which are possible in the range of its technical ideas.

What is claimed is:

1. A fixing device comprising:
a heater;
a rotatable member adapted to be heated by said heater;
a pressure member for forming a nip together with said heated rotatable member;
a temperature detection member for detecting a temperature of said heated rotatable member;
an energizing control means for controlling energization of said heater; and
selecting means for selecting, from a plurality of temperatures, a temperature to be maintained by said energizing control means after a recording medium has passed through the nip,
wherein said energizing control means controls energization of said heater on the basis of the temperature selected by said selecting means before said rotatable heated member stops rotating.

2. A device according to claim 1, wherein said selecting means selects the temperature for temperature control on the basis of an output of said temperature detection member immediately after the recording medium has passed through said nip.

3. A device according to claim 2, wherein when the output of said temperature detection member immediately after the recording medium has passed through the nip is greater than a predetermined fixing temperature, said selecting means selects a temperature which is lower than the predetermined fixing temperature.

4. A device according to claim 2, wherein when the output of said temperature detection member immediately after the recording medium has passed through the nip is less than a predetermined fixing temperature, said selecting means selects the predetermined fixing temperature.

5. A device according to claim 1, wherein said selecting means selects a temperature for temperature control on the basis of energizing time of said heater during fixing the recording medium.

6. A device according to claim 5, wherein said selecting means selects a temperature which is lower than a predetermined fixing temperature with the exception of full energization during fixing the recording medium.

7. A device according to claim 5, wherein said selecting means selects a predetermined fixing temperature in the case of full energization during fixing the recording medium.

8. A device according to claim 1, wherein said selecting means selects a temperature for temperature control on the basis of a size of the recording medium.

9. A device according to claim 8, wherein when the size of the recording medium is larger than a predetermined size, said selecting means selects a temperature which is lower than a predetermined fixing temperature.

10. A device according to claim 8, wherein when the size of the recording medium is less than a predetermined size, said selecting means selects a predetermined fixing temperature.

11. A device according to claim 1, wherein said selecting means selects the temperature for temperature control on the basis of the number of performed fixing operations.

12. A device according to claim 11, wherein when the number of performed fixing operations is more than a predetermined number, said selecting means selects a temperature which is lower than a predetermined fixing temperature.

13. A device according to claim 11, wherein when the number of performed fixing operations is less than the predetermined number, said selecting means selects a predetermined fixing temperature.

* * * * *

UNITED STATES PATENT AND TRADEMARK OFFICE

CERTIFICATE OF CORRECTION

PATENT NO. : 5,436,709

DATED : July 25, 1995

INVENTOR(S) : KATSUHIRO SAKAIZAWA, ET AL.

It is certified that error appears in the above-indentified patent and that said Letters Patent is hereby corrected as shown below:

Figure 3,
"THERMISTOSWITCH" should read --THERMISTOR SWITCH--.
Figure 7,
"THERMISTOSWITCH" should read --THERMISTOR SWITCH--.
Figure 11,
"THERMISTOSWITCH" should read --THERMISTOR SWITCH--.
Figure 15,
"THERMISTOSWITCH" should read --THERMISTOR SWITCH--.
Column 6,
line 1, "mister)" should read --mistor)--;
line 4, "thermister 207" should read --thermistor 207--; and
line 68, "thermister," should read --thermistor,--.
Column 8,
line 68, "inputted" should read --input--.

UNITED STATES PATENT AND TRADEMARK OFFICE

CERTIFICATE OF CORRECTION

PATENT NO. : 5,436,709

DATED : July 25, 1995

INVENTOR(S) : KATSUHIRO SAKAIZAWA, ET AL.

It is certified that error appears in the above-indentified patent and that said Letters Patent is hereby corrected as shown below:

Column 9,
line 52, "a" should be deleted; and
line 53, "in" should read --in a--.

Column 10,
line 51, "times 242" should read --timer 242--; and
line 57, "turned" should read --is turned--.

Signed and Sealed this

Twenty-first Day of November, 1995

Bruce Lehman

BRUCE LEHMAN

*Commissioner of Patents and Trademarks*

*Attest:*

*Attesting Officer*